US012055041B2

(12) United States Patent
Reinås et al.

(10) Patent No.: US 12,055,041 B2
(45) Date of Patent: Aug. 6, 2024

(54) APPARATUS AND METHOD FOR REMOVING SOIL FROM A CONDUIT

(71) Applicant: EQUINOR ENERGY AS, Stavanger (NO)

(72) Inventors: Lorents Reinås, Stavanger (NO); Morten Sæther, Lillestrøm (NO); Harald Sigurd Nesse, Sandnes (NO); Kjell Einar Ellingsen, Tananger (NO); Jone Stangeland, Sola (NO); Geir Gundersen Fuhr, Sola (NO)

(73) Assignee: EQUINOR ENERGY AS, Stavanger (NO)

( * ) Notice: Subject to any disclaimer, the term of this patent is extended or adjusted under 35 U.S.C. 154(b) by 123 days.

(21) Appl. No.: 17/637,952

(22) PCT Filed: Aug. 27, 2020

(86) PCT No.: PCT/NO2020/050218
§ 371 (c)(1),
(2) Date: Feb. 24, 2022

(87) PCT Pub. No.: WO2021/040534
PCT Pub. Date: Mar. 4, 2021

(65) Prior Publication Data

US 2022/0282576 A1 Sep. 8, 2022

(30) Foreign Application Priority Data

Aug. 27, 2019 (GB) ..... 1912263

(51) Int. Cl.
*E21B 7/20* (2006.01)
*E21B 37/00* (2006.01)

(52) U.S. Cl.
CPC ..... *E21B 7/201* (2013.01); *E21B 37/00* (2013.01)

(58) Field of Classification Search
CPC ..... E21B 7/201; E21B 37/00; E21B 10/44; B08B 9/0436; E02D 29/06
See application file for complete search history.

(56) References Cited

U.S. PATENT DOCUMENTS

| | | | |
|---|---|---|---|
| 3,864,923 | A | 2/1975 | Turzillo |
| 6,904,856 | B2 | 6/2005 | Wallace |
| 2004/0022585 | A1 | 2/2004 | Wallace |

FOREIGN PATENT DOCUMENTS

| | | |
|---|---|---|
| CN | 110185081 | 8/2019 |
| JP | 2001-159288 | 6/2001 |

(Continued)

OTHER PUBLICATIONS

International Search Report issued Oct. 21, 2020 in International Application No. PCT/NO2020/050218.

(Continued)

*Primary Examiner* — James G Sayre
(74) *Attorney, Agent, or Firm* — Wenderoth, Lind & Ponack, L.L.P.

(57) ABSTRACT

An apparatus for removing soil from a conduit for a subsea well that is forced or placed into a seabed is provided. The apparatus comprises a soil disturbance device to displace soil within the conduit before drilling is performed. A method of removing soil from a conduit for a subsea well that is forced or placed into a seabed is also provided. The method comprises using a soil disturbance device to displace soil within the conduit before drilling is performed.

22 Claims, 2 Drawing Sheets

(56) References Cited

FOREIGN PATENT DOCUMENTS

| | | | | | |
|---|---|---|---|---|---|
| KR | 20150026428 | A | * | 9/2013 | ..... E02D 29/06 |
| KR | 10-2015-0026428 | | | 3/2015 | |
| WO | 01/96669 | | | 12/2001 | |
| WO | 02/20908 | | | 3/2002 | |
| WO | 2010/105258 | | | 9/2010 | |

OTHER PUBLICATIONS

Written Opinion of the International Searching Authority issued Oct. 21, 2020 in International Application No. PCT/NO2020/050218.

Patents Act 1977: Combined Search and Examination Report under Sections 17 and 18(3) issued Feb. 14, 2020 in corresponding GB Application No. GB1912263.9.

* cited by examiner

APPARATUS AND METHOD FOR REMOVING SOIL FROM A CONDUIT

The invention relates to an apparatus for removing soil from a conduit for a subsea well that is forced or placed into a seabed and a method of removing soil from a conduit for a subsea well that is forced or placed into a seabed.

When constructing a subsea well, typically, a hole is drilled in the seabed and a conductor is installed in the drilled hole and cemented in place. Once secured, a drill and part of a drill string are passed through the conductor so that further drilling of the wellbore can be performed below the conductor.

For certain well installations (such as when installing a subsea well in a soft seabed) it is possible and/or desirable to install the conductor by simply forcing it into the seabed rather than drilling a hole in the seabed first. However, this installation method results in soil within the conductor. In such circumstances, the conductor has a first free end that is above the seabed or at around the same level as the sea bed, and a second buried end that is embedded in the seabed and which is lower than the free end. In some instances a conductor housing may be attached to what will be the higher end of the conductor once embedded into the sea bed. In such instances the end of the conductor housing not attached to the conductor is may be referred to as the free end of the conductor.

Additionally, it is possible for soil to end up in a conductor placed in a conventionally drilled top-hole. This may for example occur if the top-hole drilling and conductor installation is performed from a vessel other than a rig.

Currently, any soil within the conductor is removed using the drill that will be used to perform the further drilling of the well bore. However, this increases the drilling time, especially if the drill size has to be changed between clearing the soil out of the conductor and drilling the hole beneath the conductor. Also, because the drill is not designed for this purpose, removing soil from the conductor using the drill on the drill string can result in not all the soil being removed from the conductor and/or can result in damage to the conductor.

As a result, there is a need for an alternative way to remove soil from a conductor for a subsea well.

In a first aspect, the present invention provides an apparatus for removing soil from a conductor for a subsea well that is forced or placed into a seabed, wherein the apparatus comprises a closure means for closing the free end of the conductor, and a soil disturbance device for displacing soil within the conduit before drilling is performed.

In a second aspect, the present invention provides a method of removing soil from a conductor for a subsea well that is forced or placed into a seabed, wherein the method comprises closing the free end of the conductor and then using a soil disturbance device to displace soil within the conductor before drilling is performed.

The apparatus of the first aspect may be used to perform the method of the second aspect and the method of the second aspect may be performed using the apparatus of the first aspect. The following description, including optional features is applicable to both the first and second aspect of the invention. This is because method features may be performed using the apparatus and/or the apparatus may be suitable for and/or arranged to perform the method features. The apparatus features may be features of the apparatus used to perform the method. Thus the method may comprise providing and/or using an apparatus of the first aspect, optionally including one or more of the below described optional features.

A result of removing soil from a conductor for a subsea well before drilling is performed using the apparatus and method of the present invention, is that it is not necessary to remove soil from the conductor using the drill and drill string. This means that the time the drill string is in use may be reduced (and hence rig and/or drilling equipment time, which can be very costly, may also be reduced).

Further, using the apparatus and method of the present invention means that a tool that is more suited for the purpose of removing soil from the conduit for the subsea well than a drill and drill string may be used. Using a tool more suited for the purpose means that soil can be more reliably removed and/or damage to the conductor can be avoided or at least reduced. The apparatus may not be connected to any part that extends to the surface of the sea. The apparatus may not be part of, and/or may not be connected to a drill or drill string.

The apparatus may be releasably fixed onto the conductor. The apparatus may be operated using a remote operating vehicle (ROV).

The apparatus may be actuated, controlled, and/or powered by a ROV.

When the apparatus is installed and the conductor has been forced or placed into the seabed, the conductor may be closed or sealed at the free end using the apparatus and at the buried end by the seabed that the conductor has been forced or placed into.

The closure means may comprise a lid, cap or plug. The closure means is for closing the free end of the conductor. The closure means may be for sealing to the free end of the conductor. The closure means may comprise a seal for sealing to the conductor. The closure means may fit over and seal the free end of the conductor.

The method comprises forming a closed and/or sealed volume within the conductor. The free end of the conductor may be closed/sealed before the use of the soil disturbance device. The free end of the conductor may be closed/sealed for at least a portion of the time that the soil disturbance device is used.

The soil disturbance device is adapted to displace (e.g. dislodge) soil within the conductor. The soil in the conductor may be entrained or suspended in the liquid within the conductor because it is of a density only a little higher than the liquid in the conductor and as a result little material, once distributed and suspended in the liquid, will remain entrained or suspended in the liquid for a time sufficient to allow that liquid and soil to be moved out of the conductor. Alternatively or additionally, the soil may be entrained within the liquid within the conductor as a result of the rate of flow of the liquid through the conductor.

The apparatus may be removed and/or detached from the conductor before drilling is performed.

The closure means may comprise at least one inlet means. The or each inlet means may include or comprise an inlet passage for fluid communication between the outside of the conductor, and the volume inside of the conductor (hereafter simply referred to as inside the conductor).

The inlet passage may further comprise one or both of an outer inlet port and an inner inlet port. The outer inlet port may be adapted to engage with a pressurised liquid source may be adapted to engage with a pressurised liquid source such as a pump. The pressurised liquid source may be mounted on or a part of an ROV. The pressurised liquid is liquid that is at a pressure greater than the pressure of the seawater in the region of the free end of the conductor. The pressurised liquid may be seawater drawn from the region of the free end of the conductor and pressurised by the pressurised liquid source. The pressurised liquid source may be a suitable pump mounted on or which is part of an ROV.

The closure means may comprise at least one outlet means. The or each outlet means may include or comprise an outlet passage for fluid communication between the inside of the conductor and outside of the conductor. One or more of the outlet passages may comprise an outlet mouth which opens in the outside face of the closure means (the outside face of the closure means is the face that faces away from the inside of the conductor). In such an embodiment liquid leaving the outlet mouth mixes with the seawater in the region of the outlet mouth. Soil entrained or suspended in the water leaving the outlet mouth may settle onto the seabed close to the conductor or may be carried away from the conductor by local currents.

A benefit of the presence of the closure means is that it prevents that soil settling back into the conductor.

In other embodiments, one or more of the outlet passages may comprise an outlet port on the outside face of the closure means. The outlet port may be adapted to engage with a source of underpressure such as a pump. That engagement may be direct engagement or via a pipe or tube. This may also be described as sucking the liquid from inside the conduit out of the conductor through one or more outlet passages. An underpressure in this context is a pressure below the pressure in the conductor. The greater the underpressure created by the pump or underpressure source the greater the rate of flow of the liquid and any entrained or suspended soil out of the conduit through the or each outlet passage.

A further benefit of the use of the closure means is that it allows the liquid pressure inside the conductor to be increased or decreased relative to the liquid pressure outside and in the region of the mouth of the conductor.

The soil disturbance device may remove soil from the inside surface of the conductor such that the conductor (at least the length of conductor over which the apparatus operates) is substantially cleaned of soil. Whilst a small amount of soil may be left within and on the inside surface of the conductor after the apparatus has been used/the method has been performed, this may be a sufficiently small amount such that it does not interfere with further drilling below the conductor and/or installations of components such as casings etc. within and/or through the conductor.

The apparatus may remove soil from the conductor from around the apparatus.

The soil disturbance device may cause soil within the conductor to go into suspension or become entrained in the liquid, such as sea water, within the conductor. Liquid with the soil in suspension may then be removed from the conductor, via an outlet into closure means, so as to remove the soil from the conductor.

The soil disturbance device may comprise a mechanical soil disturbance device and/or a fluid flow soil disturbance device. Thus the method may comprise using a mechanical soil disturbance device and/or a fluid flow soil disturbance device to displace soil within the conductor before drilling is performed.

The mechanical soil disturbance device and the fluid flow soil disturbance device, if both are present, may be used in combination to displace the soil. The soil disturbance device may be used to cause the removal of soil from the conductor and/or clean the inside of the conductor. Once the apparatus has been used and/or the method has been performed, at least part of the conductor may be substantially clear of soil.

The mechanical soil disturbance device may be a device that displaces soil by a moving physical part of the apparatus that contacts the soil.

The fluid flow soil disturbance device may be a device that displaces soil using fluid flow that contacts and disturbs the soil.

The mechanical soil disturbance device may for example comprise a rod, screw, blades and/or scraper that are for displacing/dislodging soil within the conductor. The rod, screw, blades and/or scraper may contact the soil within the conductor and displace/dislodge it.

The mechanical soil disturbance device may be movable within the conductor. The method may comprise moving the soil disturbance device.

The mechanical soil disturbance device may be, and/or have at least a portion that is, for moving along and/or near the inside surface of the conductor so as to displace the soil. For example, the mechanical disturbance device may have a maximum outer diameter that is approximately the same as the inner diameter of the conductor. For example, the maximum outer diameter of the mechanical soil disturbance device may be at least 90% or at least 95% of the minimum inner diameter of the conductor.

The mechanical soil disturbance device may be arranged so that in use it can move within the conductor and disturb the soil within the conductor. The mechanical soil disturbance device may be arranged so that in use it can move within the conduit so as to cause liquid (e.g. containing soil) to flow out of the conductor via an outlet passage in the closure means. The mechanical soil disturbance device may be architectural and controlled and/or powered using a ROV.

The apparatus may comprise an actuator for moving the mechanical soil disturbance device. The actuator may comprise an ROV interface. The ROV interface may be integral with the closure means and allow power or torque from the ROV to pass through the closure means. In other embodiments, the actuator interface may extend through the closure means. In such embodiments the interface between the actuator and the closure means may be sealed so that liquid cannot flow through the closure means alongside the actuator.

The apparatus may comprise a lance. The lance may extend into the conductor. The mechanical soil disturbance device may travel along the lance.

The lance may be part of the actuator. The actuator may comprise a nut. For example the actuator may comprise an externally threaded lance and an internally threaded nut. The lance may be a long, relatively thin, protrusion that when the apparatus is installed, extends along at least a portion of the length of the conduit (this may also be regarded and/or referred to as a rod, bolt, screw, pole, spoke etc). The lance may act as a drive screw for the nut. The lance may comprise a helical screw thread. When the apparatus is mounted on/within the conductor, the lance may extend along the centre of the conductor. The threaded nut may move along, i.e. up and down, the lance when the lance and nut are rotated relative to each other. For example, the lance may be rotated, e.g. by an ROV. The lance may be connected to or comprise an ROV interface. The apparatus may be arranged such that when the ROV interface is rotated the lance is rotated. The rotation of the ROV interface and hence of the lance may cause the nut to move along, e.g. up and/or down, the lance. The apparatus may comprise a stop at or towards the end of the lance remote from the ROV interface. The stop may be present to keep the nut on the lance and to cause it to move back up the lance once it has reached the bottom of the lance. If the apparatus comprises a centraliser (as described below), the centraliser may act as the stop.

When the apparatus is installed on/in the conductor the lance and/or nut may be located within the conductor. The lance and nut may be inside the conductor.

The mechanical soil disturbance device may be connected to and/or integral with the nut. The mechanical soil disturbance device may extend radially outward from the nut. The mechanical soil disturbance device may for example comprise one or more blades that extend radially outward from the nut. The maximum outer diameter of the blades may be approximately equal (e.g. within 95% of) the minimum inner diameter of the conductor.

Rotation of the lance (e.g. using the ROV interface) may cause the nut, and hence mechanical soil disturbance device, to move along the lance and hence up and down (in an axial direction) within the conductor. The mechanical soil disturbance device may move along the lance between the closure means at the top and the barrier end of the conductor at the bottom of the lance.

The movement of the mechanical soil disturbance device may dislodge soil within the conductor. The mechanical soil disturbance device may be moved within the conductor so as to move the liquid within the conductor. Thus when the mechanical soil disturbance device is moved, soil within the conductor may be dislodged and then removed from the conductor by movement of liquid out of the conductor. Movement of the mechanical soil disturbance device in an upward direction (from the buried end toward the free and of the conductor) may push fluid and/or soil up and out of the conductor.

The apparatus, e.g. the lance, when installed in the conductor, may extend at least over the length (in an axial direction) of the conductor from which it is desired that soil to be removed. This may be the full length of the conductor. Alternatively, this may be a top portion of the conductor such as at least the uppermost three quarters or half of the conductor. It may be acceptable for soil to not be removed from the lowermost portion of the conductor. This is because it may be acceptable for the soil to be removed from this section using a drill. This is because incomplete removal of soil from this portion may not hinder installation of casings etc. within the conductor and/or it may be acceptable for this portion of the conductor to be damaged by drilling operation.

The mechanical soil disturbance device may be movable along the length of the apparatus.

The lance may be centred within the conductor. The apparatus (e.g. the lance of the apparatus) may be centred within the conductor by means of a centraliser. The apparatus may comprise a centraliser. The centraliser may be located at or towards the bottom of the apparatus (i.e. the end of the apparatus furthest from the closure means). This is because an attachment between the apparatus and conductor at the free end of the conductor may centralise the apparatus and lance at the free end of the conductor and hence the centraliser at or towards the buried end of the conductor of the apparatus may help ensure that the apparatus (e.g. the lance) is centralised towards the buried end of the conduit.

The centraliser may be connected to the lance. The centraliser may have one or more arms that extend radially outward from the lance. The centraliser may have an outer surface that in use rests against the inside surface of the conductor.

The length between the lance and the outer surface of the centraliser may be approximately equal to the radius of the conductor.

The centraliser may help support and/or guide the apparatus through the conductor as the apparatus is being installed.

The introduction of liquid into the conductor may cause liquid to flow out of the conduit. Such liquid flow may be used to remove soil from the conductor, e.g. soil that has been displaced and put into suspension in the liquid inside the conductor.

The liquid inlet in the closure means may comprise a plurality of apertures, e.g. nozzles/jets, through which liquid may flow into the conductor. The apertures may form the liquid flow soil disturbance device. The apertures may be constrictions through which the liquid flows into the conductor. The apertures may result in jets of liquid, such as seawater, that cause the soil to be dislodged/disturbed and put into suspension in the liquid within the conductor. The liquid, e.g. the liquid with soil suspended therein, may be removed from the conductor via one or more outlet passage in the closure means. This may be due to liquid flowing into the conduit through the inlet passage and hence apertures. Liquid may be forced into the inlet passage and through the apertures under pressure. Thus liquid exiting the apertures may form jets of liquid that displace soil within the conductor and/or cause liquid to flow out of the conductor.

When the apparatus comprises a lance the apertures may be located on the lance. The liquid inlet passage through the closure means may be in liquid communication with the lance. The lance may have a passage for liquid therethrough. In use, liquid may flow into and through the lance to the apertures. Thus the lance may provide the fluid flow soil disturbance device. Thus the lance may have the dual purpose of providing part of (the actuator for) the mechanical soil disturbance device and apertures for the liquid flow soil disturbance device.

When the lance is rotated so as to cause the mechanical soil disturbance device to move along its length, the apertures may be rotated so that jets of liquid ejected therefrom are rotated. This means that liquid may be jetted onto the inside surface of the conductor around the entire internal circumference. The apertures may be spaced such that liquid jets from the apertures overlap in an axial direction. As a result, substantially all of the inside surface of the conductor along the length over which the apertures are provided may be contacted by the liquid jets.

The apertures may be located at least at or near the bottom of the lance (the end of the lance furthest from the free end of the conductor). This is so that the liquid flow caused by liquid flowing into the conductor may occur over the full length of the apparatus. The apertures may be located along the length of the apparatus, e.g. along the length of the lance. The apparatus may comprise apertures at least at 5 or 10 or more distinct axial heights or distances along the length of the apparatus.

The closure means may comprise an outlet passage. Liquid and soil may pass through the outlet. Liquid may flow from the inlet passage (through the apertures) to the outlet passage. Thus, the apparatus is arranged such that there may be liquid circulation into and out of the conductor.

The length of the conductor cleaned by the apparatus may be approximately equal in length to the length of the apparatus.

Liquid may be forced into the conductor through the inlet passage and/or forced out of the conductor through the outlet passage. For example, liquid may be pumped into and/or out of the conductor through the liquid inlet passage and outlet passage respectively. The liquid inlet passage and/or the outlet passage may have a pump interface onto which a pump may be connected. The apparatus may comprise one or more pumps for pumping liquid into the inlet passage and/or liquid out of the outlet passage. Liquid, such as seawater, without soil in suspension may be forced into the conductor (e.g. through the inlet passage, lance and apertures) and the liquid may, once inside the conductor, have soil suspended therein before being removed from the conductor via the outlet passage so as to also remove soil from the conductor. This may be repeated until at least a portion of the conductor is substantially free from soil, i.e. sufficiently free from soil such that components, such as casings, can be mounted within the conductor without any further soil removal operations having to be performed in the cleaned portion of the conductot. Thus the liquid flow may be used to flush the inside of the conductor.

In use, liquid may be forced into the conductor through one or more inlet passages and hence apertures. This results in jets of liquid flowing into the conductor that may act as the fluid flow soil disturbance device. The jets of liquid may dislodge soil within the conductor. The jets may also cause liquid to leave the conductor and remove soil therewith. Prior to, at the same time as and/or subsequently to the operation of the liquid flow soil disturbance device, the mechanical soil disturbance device may be operated.

The apparatus may comprise a conductor protector. The conductor protector may extend over only a portion of the length of the apparatus. The conductor protector may extend over only a portion of the length of the conductor when the apparatus is installed in the conductor. The conductor protector may be used to protect a portion of the conductor that it is imperative is not damaged during the cleaning operation. For example, this may be a portion of the conductor that has an internal profile and/or a portion from which other tubulars, such as casings may be hung.

The conductor protector may be used to cover a portion of the internal surface of the conductor.

The soil disturbance device (e.g. the mechanical soil disturbance device and/or the liquid flow soil disturbance device) may extend through the conductor protector.

The minimum inner diameter of the conductor protector may be substantially the same as the maximum outer diameter of the mechanical soil disturbance device.

When the apparatus is not in use, the mechanical soil disturbance device may be housed within the conductor protector. Thus, the mechanical soil disturbance device may be protected by the conductor protector, e.g. during transportation of the apparatus.

The mechanical soil disturbance device may be housed within the conductor protector when the apparatus is being installed into and/or removed from the conductor. This may minimise the risk of the mechanical soil disturbance device and/or the conductor being damaged during installation and/or removal of the apparatus.

The conductor protector may be for protecting a portion of the conductor that has not been forced or placed into the seabed, i.e. a part that protrudes above the surface of the seabed. This may for example be the uppermost portion of the conductor. This part of the conductor may be protected (and hence not cleaned by the soil disturbance device of the apparatus) as there is no soil to be removed from this portion of the conductor protector.

The conductor protector may be connected to the closure means of the apparatus.

The conductor protector together with the closure means may, in use, create a seal with the conduit.

The conductor protector may be a tube with a cross sectional shape and/or size corresponding to the portion of conductor it, in use, protects.

The conductor protector may have an outer diameter that is substantially the same as the minimum inner diameter of the portion of the conductor it protects. Thus the conductor protector may fit closely into the portion of the conductor it protects.

The conductor discussed above may be a conduit for use in a subsea well. The conductor may comprise a conductor housing (i.e. a low pressure wellhead housing) and/or a conductor pipe. The conductor housing may be attached to the top end of the conductor pipe. In this case, the conductor protector (if present) may be for protecting (e.g. covering) the conductor housing. The conductor protector may therefore be referred to as a conductor housing protector.

The conduit may be the first installed pipe of a wellbore from which surface casings can be, or in use are, hung.

The conduit may be placed into the seabed in a pre-drilled hole. The method may comprise drilling a hole in the seabed and then placing the conduit in the hole. Such a scenario may, in certain circumstances, result in some soil within the conduit that needs to be removed.

The conduit or conductor may be forced into the seabed by piling and/or suction. The conduit may be forced directly into the seabed. The conduit may be forced into the seabed without a hole being drilled first. The conduit may be connected to a suction anchor. The conduit or conductor may be forced into the seabed by the suction anchor being sucked into the seabed.

The conduit may for example be the centre pipe of a suction anchor.

The conduit may be forced or placed into the seabed such that a portion of the conduit protrudes from the top of the seabed. The protruding portion may be a portion from which internal tubular(s) can be landed and/or hung. For example, the protruding portion may be a conductor housing. In this case a high pressure well head housing and associated casing may be landed/hung therein.

The apparatus as described above may be installed in the conduit after the conduit has been forced or placed into the seabed. In this case, the soil disturbance device, e.g. the fluid flow soil disturbance device, may be used to clear and/or dislodge at least some of the soil during installation of the apparatus into the conduit. For example, liquid may be forced through the apparatus, e.g. forced through the lance, so as to facilitate installation of the apparatus. Alternatively, the soil disturbance device may not be operated until it is fully installed in the conduit. Thus the apparatus may be forced through the soil within the conduit.

Once the apparatus is fully installed, and the closure means has closed the upper end of the conduit (the free end), the apparatus and hence soil disturbance device may be used to remove substantially all the soil from the conduit (at least from the length of the conduit over which the apparatus extends).

The apparatus may be installed in the conduit before it is forced or placed into the seabed. Thus, the conduit may be forced or placed into the seabed with the apparatus mounted therein.

The apparatus (e.g. the soil disturbance device such as the mechanical soil disturbance device and/or the liquid flow soil disturbance device) may be operated whilst the conduit is being forced or placed into the seabed. Thus, soil may be dislodged and/or removed from the inside of the conduit whilst it is being forced or placed into the seabed. Thus the apparatus may make forcing or placing the conduit into the seabed easier.

When the apparatus is mounted on the conduit before it is forced or placed into the seabed, liquid may leave the conduit via an outlet passage whilst the conduit is being forced or placed into the seabed. Liquid may be pumped out of the conduit, e.g. via the outlet passage, so as to create suction within the conduit. This may help and/or cause the conduit to be forced or placed into the seabed.

Such suction may be in addition to suction provided by a surrounding suction anchor (if present).

Irrespective of whether the apparatus is installed on the conduit before it is forced or placed into the seabed or installed on the conduit after the conduit has been forced or placed into the seabed, the apparatus will be forced into soil inside the conduit. The mechanical soil disturbance device and/or the fluid flow soil disturbance device may be operated whilst the apparatus is forced into/through soil inside the conduit.

Once the soil has been removed from the conduit, the apparatus may be removed from the conduit. Following this, a drill and/or drill string may be passed through the conduit so that a bore hole may be drilled below the conduit.

The apparatus may not be operated until the conduit is forced or placed into the seabed to the desired position. Thus the apparatus may be forced through the soil within the conduit whilst the conduit is being forced or placed into the seabed. However, the apparatus may be arranged to allow liquid to leave the conduit (e.g. by opening the outlet passage) whilst the conduit is being forced or placed into the seabed. This is so that the apparatus does not impede the forcing of the conduit into the seabed.

The method may comprise providing the apparatus, installing the apparatus in the conduit, closing the end of the conduit with the closure means, operating the soil disturbance device, forcing liquid into and out of the conduit via the inlet and outlet passages, removing soil from the apparatus, and/or removing the apparatus from the conduit.

Whilst the terms subsea and seabed etc. are used herein, it should be appreciated that this means the bed under any large body of water such an ocean, lake etc. and on any corresponding water bed.

The term "soil" used herein is intended to refer to any of the material of the seabed (i.e. waterbed) into which the conduit has been forced or placed. This for example may comprise sand, rocks, pebbles, stones, clay, mud, organic matter etc.

The apparatus and method may be used with soft soil. For example, soil that is soft enough for a suction anchor to be sucked into the ground.

The apparatus may be referred to as a soil removing apparatus.

The invention described above has largely been described with reference to a conductor. It is to be understood the reference to the conductor includes reference to the conduits used in subsea or underwater applications.

There may be provided a system comprising the apparatus and the conductor or conduit. The apparatus and/or the conduit may comprise one or more of the above described features, including optional features. The system may include at least one ROV which controls, actuates and or powers the apparatus.

A system including the apparatus of the present invention and one or more ROVs is particularly beneficial because although ROVs have significantly less power that rigs or other drilling vessels they have sufficient power to power the apparatus. The ROV and apparatus are significantly less expensive to operate and less likely to damage the conduit than a rig or other drilling vessels.

Whilst the device and method disclosed herein are for removing soil from a conduit for a subsea well, they could also be used to remove soil or other debris from other conduits for other purposes and/or in other locations.

Certain preferred embodiments of the present invention will now be described by way of example only with reference to the accompanying drawings, in which:

FIG. 1 shows a soil removing apparatus 1 for removing soil from a conduit for a subsea well that is forced into a seabed.

Figure 1:
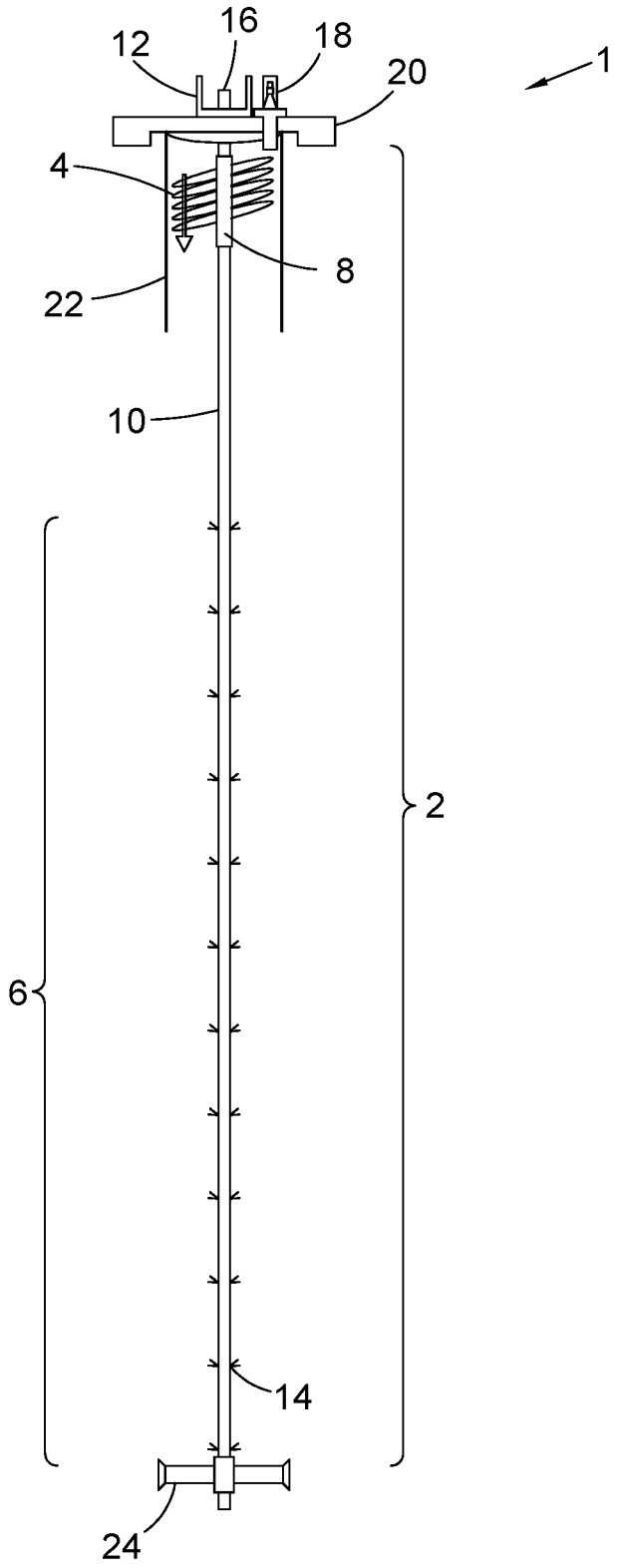
FIG. 1 shows an apparatus for removing soil from a conduit or conductor for a subsea well that is forced or placed into a seabed.

The apparatus 1 comprises a soil disturbance device 2 that comprises a mechanical soil disturbance device 4 and a liquid flow soil disturbance device 6.

The mechanical soil disturbance device 4 comprises a plurality of blades. The blades are connected to an internally threaded nut 8 that is mounted on an externally threaded lance 10. The lance 10 is connected at its top end to an ROV interface 12.

Located along the length of the lance 10 are a plurality of apertures 14 (for clarity only one of the twelve sets of apertures 14 is labelled with a reference numeral in the figure). The apertures 14 provide the liquid flow soil disturbance device 6.

The apparatus 1 comprises a liquid inlet 16. The liquid inlet passage 16 is in liquid communication with the apertures 14.

The apparatus 1 comprises an outlet passage 18 through which liquid and soil can pass out of the conduit. The inlet passage 16 and outlet passage 18 extend through a lid 20. The lid 20 may be for sealing to the conduit when the apparatus 1 is installed.

The apparatus 1 comprises a conduit protector 22. The conduit protector 22 is connected to the lid 20. When the apparatus 1 is installed in a conduit the conduit protector 22 covers, and optionally contacts, an uppermost portion thereof.

Towards the bottom of the lance 10 is a centraliser 24. The centraliser 24 is for guiding and supporting the lance 10 within the conduit. The centraliser 24 also acts as a stop to prevent the nut 8 moving off the bottom of the lance 10 when the lance is rotated.

Figure 2:
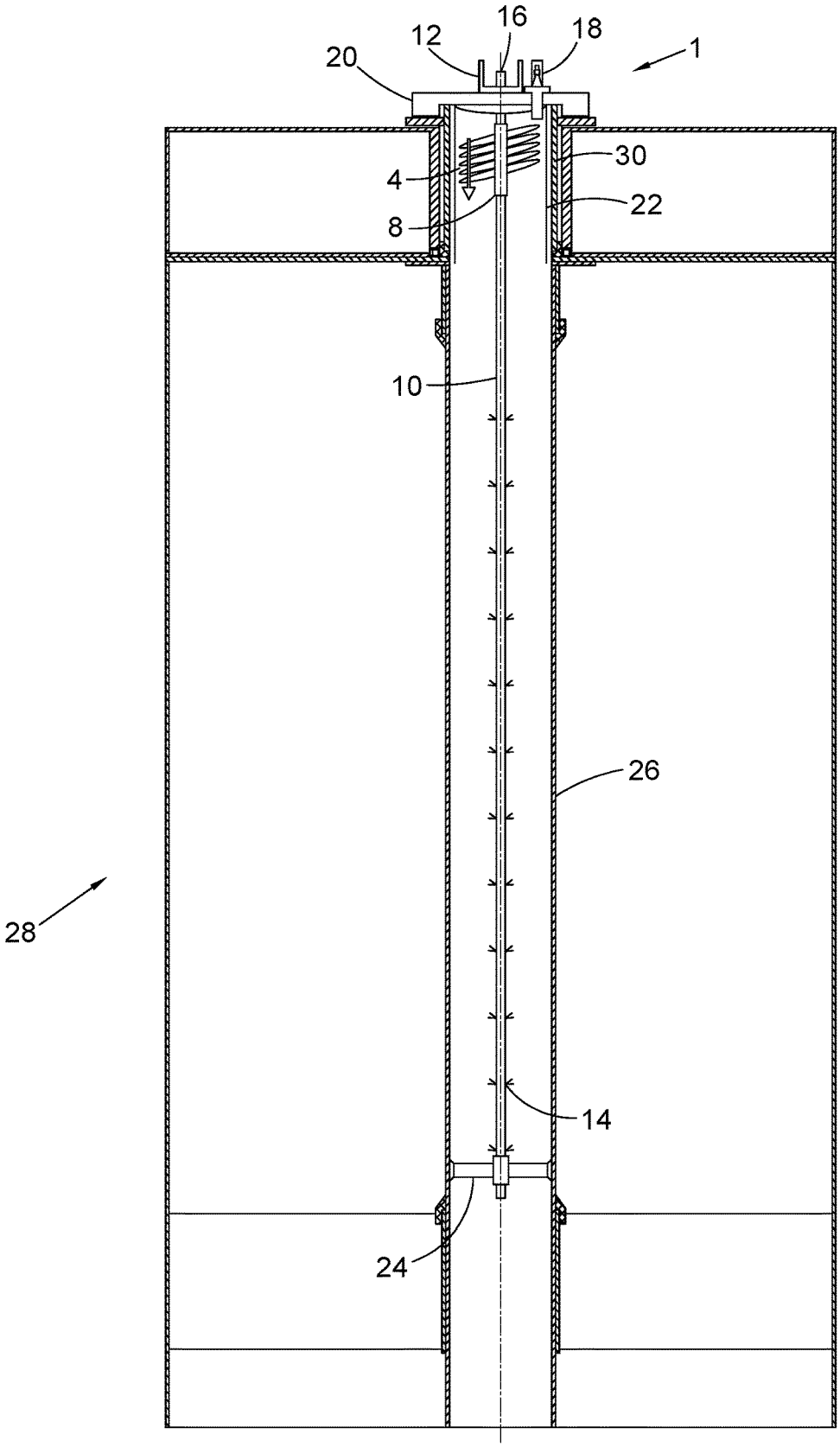
FIG. 2 shows the apparatus mounted in a conduit for a subsea well.

FIG. 2 shows the apparatus 1 of FIG. 1 mounted in a conduit 26. In this case the conduit 26 is the centre pipe of a suction anchor 28. Although the apparatus 1 is shown in a centre pipe 26 of a suction anchor, the conduit for a subsea well cleaned by the apparatus 1 does not need to be part of a suction anchor. The apparatus can equally be used to displace soil from a conduit that is not part of a suction anchor. Such a conduit may have been forced into the seabed by a means other than suction, such as by piling or placed in a drilled hole.

At the top of the conduit 26 is a conductor housing 30. Once the conduit 26 has been forced into the seabed at least the conductor housing 30 may protrude from the top of the seabed. Thus there may be no soil within the conductor housing 30 after the conduit 26 has been forced into the seabed.

The apparatus 1 is installed in the conduit 26 as shown in FIG. 2. The bottom end of the lance 10 and centraliser 24 are first inserted into the top end of the conduit 26. The apparatus 1 is supported and guided down within the conduit 26 by the centraliser 24. The apparatus 1 is inserted further into the apparatus 1 until the conduit protector 22 is within the conductor housing 30 and the lid 20 is in contact with the top of the conduit 26 (i.e. the top of the conductor housing 30). The apparatus 1 may then seal with the top end of the conduit 26 via the lid 20 and/or the conduit protector 22. At this point a closed volume may be formed within the conduit 26. The closed volume is formed within the conduit 26 by the top end being sealed by at least the lid 20 and the bottom end being sealed by soil.

The apparatus 1 may be installed within the conduit 26 before the conduit is forced into the seabed. Alternatively the apparatus 1 may be installed within the conduit 26 after the conduit 26 has been forced into the seabed. In either case the apparatus 1 will be forced through soil within the conduit 26. The soil disturbance device 2 (e.g. the mechanical soil disturbance device 4 and/or fluid flow soil disturbance device 6) may be operated as the apparatus is forced through soil within the conduit 26. This may ease the installation of the apparatus 1.

The mechanical soil disturbance device 4 may be operated by rotating the lance 10. The lance 10 may be rotated using the ROV interface tool 12.

Rotation of the lance 10 causes the nut 8 to move along the lance 10. This causes the blades of the mechanical soil disturbance device 4 connected to the nut 8 to also move along the lance 10 such that they can act to displace soil.

Upon continued rotation of the lance 10 the nut 8 moves down along the lance 10 until it reaches the stop at the end of the lance 10 (in this case the centraliser 24). At that point, upon continued rotation, the nut 8, together with the blades 4, moves back up the lance 10 until it reaches the top.

Movement of the blades 4 up and down along the lance 10 within the conduit displaces soil within the conduit and moves fluid such that soil may be removed from the conduit 26.

The fluid flow soil disturbance device 6 may be operated by forcing fluid in through the inlet 16, through the lance 10, through the apertures 14 into the conduit and then out of the conduit 26 via the outlet 18. The fluid may be forced through this fluid path by means of one or more pumps (not shown) connected to the fluid inlet 16 and/or outlet 18.

The fluid flow from the apertures 14 to the outlet 18 may displace soil within the conduit 26 and remove it therefrom via soil being in suspension within the fluid.

The apertures 14 may be constrictions such that fluid flowing therethrough forms jets that act to dislodge surrounding soil.

The mechanical soil disturbance device 4 and/or the fluid flow soil disturbance device 6 may displace soil and cause it to go into suspension in the fluid within the conduit and/or may cause fluid (e.g. with soil in suspension) to flow out of the conduit 26, e.g. via outlet 18. Thus the mechanical soil disturbance device 4 and/or the fluid flow soil disturbance device 6 may act to remove soil from the conduit 26.

Once the soil has been removed from the conduit 26, the apparatus 1 may be removed from the conduit 26. After the apparatus 1 has been removed, a drill and drill string may be passed through the cleaned conduit so that drilling may be performed to create a borehole below the conduit 26.

The invention claimed is:

1. An apparatus for removing soil from a conduit for a subsea well that is forced or placed into a seabed, wherein the conduit has a first free end that is above or approximately level with the seabed and a second buried end that is embedded in the seabed, and the apparatus comprises a closure means for closing the free end of the conduit and a soil disturbance device for displacing soil within the conduit before drilling is performed, wherein the apparatus is configured to be releasably fixed onto the conduit and when the apparatus is installed on the conduit, the conduit is closed at the free end using the apparatus.

2. An apparatus according to claim 1, wherein the closure means comprises a lid, cap or plug suitable for closing the free end of the conduit.

3. An apparatus according to claim 1, wherein the soil disturbance device comprises a mechanical soil disturbance device.

4. An apparatus according to claim 3, wherein the apparatus comprises a lance along which the mechanical soil disturbance device is arranged to travel.

5. An apparatus according to claim 4, wherein the apparatus is arranged such that the mechanical soil disturbance device travels along the lance when the lance is rotated.

6. An apparatus according to claim 1, wherein the soil disturbance device comprises a liquid flow soil disturbance device.

7. An apparatus according to claim 6, wherein the apparatus comprises a plurality of apertures, through which liquid can flow into the conduit, thereby forming the liquid flow soil disturbance device.

8. An apparatus according to claim 7, wherein the apparatus comprises a lance along which the mechanical soil disturbance device is arranged to travel, and wherein the apertures are located on the lance.

9. An apparatus according to claim 1, wherein the apparatus comprises a conduit protector for covering a portion of the internal surface of the conduit.

10. An apparatus according to claim 1, wherein the apparatus comprises a centraliser located at or towards the end of the apparatus remote from the closure means.

11. An apparatus according to claim 1, wherein the conduit is a conductor.

12. An apparatus according to claim 1, wherein the conduit is a centre pipe of a suction anchor.

13. An apparatus according to claim 1, wherein the closure means comprises at least one outlet passage, and at least one outlet passage is for the flow of liquid and entrained or suspended soil out of the conduit.

14. An apparatus according to claim 13, wherein one or more outlet passage of the closure means is provided with an outlet port, and at least one outlet port is suitable for engaging with an underpressure source.

15. A system for removing soil from a conduit comprising an apparatus according to claim 14 and an underpressure source, wherein the under pressure source is an outlet pump, and the outlet pump is configured to cause an underpressure in the or each outlet passage with which it is in liquid communication.

16. A system according to claim 15 in which the outlet pump is part of or mounted on a remote operating vehicle.

17. An apparatus according to claim 1, wherein the closure means comprises at least one inlet passage, and at least one inlet passage is for the flow of liquid into the conduit.

18. An apparatus according to claim 17 wherein one or more of the inlet passages of the closure means is provided with an inlet port, and at least one of the inlet ports is suitable for engaging with a pressurised liquid source.

19. A system for removing soil from a conduit comprising an apparatus according to claim 18 and a pressurised liquid source, wherein the pressurised liquid source is an inlet pump, the inlet pump is configured to pump liquid into the or each inlet passage with which it is in liquid communication.

20. A system according to claim 19 in which the inlet pump is part of or mounted on a remote operating vehicle.

21. A method of removing soil from a conduit for a subsea well that is forced or placed into a seabed, wherein the conduit has a first free end that is above or approximately level with the seabed and a second buried end that is embedded in the seabed, the method comprises closing the free end of the conduit with a closure means, and using a soil disturbance device to displace soil within the conduit before drilling is performed.

22. A method according to claim 21, wherein the method comprises forcing liquid into the conduit and/or forcing liquid with soil suspended therein from the conduit via one or more outlet passages in the closure means so as to also remove soil from the conduit.

* * * * *